US006088839A

United States Patent [19]

Utamaru

[11] Patent Number: 6,088,839

[45] **Date of Patent: *Jul. 18, 2000**

[54] METHOD OF SUSPENDING TROUSERS

[76] Inventor: Masanobu Utamaru, 403, Hillbook House Akiya Beach, 5347, Akiya Yokosuka 240-0105, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/081,897

[22] Filed: May 20, 1998

[30] Foreign Application Priority Data

May 26, 1997 [JP] Japan ..... 9-153007

[51] Int. Cl.[7] ..... A41F 3/02

[52] U.S. Cl. ..... 2/340; 2/327; 2/326; 2/336

[58] Field of Search ..... 2/326, 327, 328, 2/336, 340, 314, 315, 323; 24/265 H, 698.1, 698.2, 698.3

[56] References Cited

U.S. PATENT DOCUMENTS

| | | | |
|---|---|---|---|
| 87,648 | 3/1869 | Demorest et al. | 2/327 |
| 287,020 | 10/1883 | Greely | 2/326 |
| 322,478 | 7/1885 | Potter | 2/327 |
| 322,480 | 7/1885 | Potter | 2/327 |
| 353,811 | 12/1886 | Potter | 2/327 |
| 1,051,167 | 1/1913 | Simmons | 2/327 |
| 2,053,169 | 9/1936 | Stork | 241/12 |
| 2,315,698 | 4/1943 | Gluckmann | 2/340 |
| 5,274,887 | 1/1994 | Fudaki | 24/265 H |
| 5,438,736 | 8/1995 | Terada et al. | 24/599.8 |
| 5,623,735 | 4/1997 | Perry | 2/326 |

FOREIGN PATENT DOCUMENTS 641101 7/1928 France .

OTHER PUBLICATIONS

Photocopies of five different hook structures prior art exhibits 1–5 (4 pages).

*Primary Examiner*—Tejash Patel
*Attorney, Agent, or Firm*—Trexler, Bushnell, Giangiorgi & Blackstone, Ltd.

[57] ABSTRACT

Suspenders and methods of using them have general-purpose properties necessitating no special processing as long as normal type trousers with belt loops are concerned, and realize quick, certain and easy fastening and undoing, and also successive application without damaging the trousers. The suspenders comprise hooks fixed at the free ends of straps in the suspenders. The method of using them comprises the step of engaging the hooks with appropriate loops selected from among the loops of trousers respectively.

2 Claims, 2 Drawing Sheets

METHOD OF SUSPENDING TROUSERS

BACKGROUND OF THE INVENTION

1. Field of the Invention

The present invention relates to suspenders for suspending trousers, and also relates to methods of suspending trousers from one's shoulders with the suspenders in order to prevent the trousers to fall from both lower extremities.

2. Description of the Related Art

Conventionally, the suspenders typically have the function to suspend trousers by connecting the respective free ends of several straps branched in the suspenders with the upper end of the trousers. The patterns of such straps branched in the suspenders can be roughly classified into four modes, namely, Y type, H type, X type and RX type, as shown in FIG. 1.

The Y type suspenders have straps with three branches of which two are for the front of trousers and one for the back thereof. The H type and the X type suspenders have straps with four branches, of which two are for the front of trousers and two for the back thereof. The RX type suspenders have straps with two branches, namely, one on each side. It is well-known in the art that the free ends of straps in the suspenders are connected with the upper end of trousers by means of a button-up connection mode or a clip-on connection mode.

The button-up connection mode fastens buttons to buttonholes respectively, which buttons are previously and exclusively sewed in a total quantity of from four to eight on predetermined positions inside of and near the upper end of trousers, and which buttonholes are provided at the respective free ends of the straps branched in the suspenders.

The clip-on connection mode connects the desired positions of the upper end of trousers with gripping teeth provided at the respective free ends of the suspenders.

It is necessary that the button-up connecting mode should previously sew from four to eight of the exclusive buttons along the inside upper end of trousers. It has not only the disadvantage or limitation in the use of the trousers having no such exclusive buttons, but also bothersome because of taking a lot of time and effort to fasten and undo many buttons.

The foregoing clip-on connecting mode seems to have good general-purpose properties, because it has solved the problem of special preparation that the button-up connection mode has. However, there is a possibility of not only damaging trousers but also injuring the fingernails upon opening the clips, because the gripping teeth of the clips tend to leave a mark at the upper end of trousers.

SUMMARY OF THE INVENTION

Accordingly, the objective of the present invention is to provide the suspenders and methods of suspending trousers which realize quick, certain and easy fastening and undoing without taking a lot of time and trouble in handling, and also successive application without damaging trousers, while they have general-purpose properties without special preparation.

The suspenders and methods of suspending trousers according to the present invention are applicable to all the normal type trousers that have loops of a width of, say, 25 mm or less for passing a belt through along the outside upper end of the trousers.

The suspenders in the present invention comprise hooks fixed at the respective free ends of straps branched in the suspenders, the hooks formed to be engageable with appropriate loops selected from among the loops arranged along the outside upper end of trousers, the said loops for passing a belt through.

According to another aspect of the present invention, the method of suspending trousers from one's shoulders using the free ends of straps branched in the suspenders comprises the steps of: fixing hooks at the free ends of straps branched in the suspenders respectively; selecting appropriate loops from among the loops arranged along the outside upper end of trousers, the said loops for passing a belt through; and engaging the hooks with the selected loops respectively.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed hereinafter in detail in terms of the preferred embodiments with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order not to unnecessarily obscure the present invention.

Figure 1:
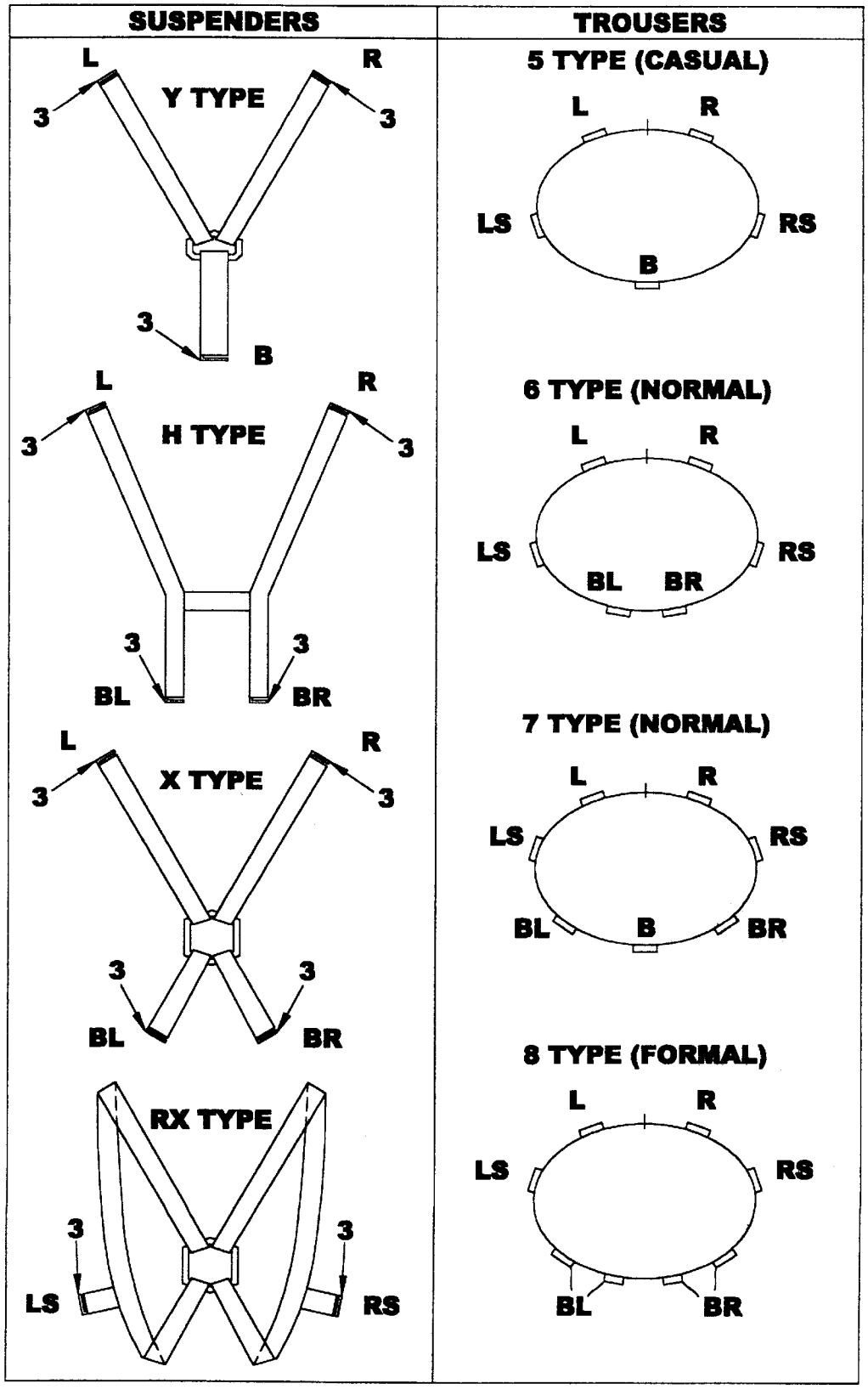
FIG. 1 is an explanation view for explaining the suspending method according to the present invention, by illustrating the relation between the position and number of the free ends of the straps in the suspenders and the position and number of the belt loops of the normal type trousers.

At first, the idea of the present invention will be discussed with reference to FIG. 1. As shown at left in FIG. 1, the configurations of the well-known suspenders are classified into four modes, namely, Y type, H type, X type and RX type. In the present invention, hooks 3 are fixed at the respective free ends of the straps branched in the suspenders as shown in FIG. 1. These hooks 3 are provided in order to engage with desired loops selected from among the belt loops of trousers respectively. On the other hand, as shown at right in FIG. 1, several loops for passing a belt through, are arranged along the outside upper end of trousers. These loops are classified into four types, namely, a casual 5 type, a normal 6 type, a normal 7 type and a formal 8 type. Accordingly, if those modes in the suspenders and these types in the trousers are combined so as to engage hooks 3 of the suspenders with appropriate loops selected from among the loops of the trousers respectively, a fine condition for suspending the trousers will be obtained.

The said Y type suspenders have a pair of front straps, and only one rear strap at the center thereof. Accordingly, the arrangement of the loops of trousers applicable to the Y type is limited to the types having the loop (B) at the rear center of trousers, i.e., the 5 type and the 7 type as shown at right in FIG. 1. The respective free ends (L, R) of the front straps of the Y type suspenders are ordinarily engaged with respective front loops (L, R) of the trousers. However, when it seems to be inconvenient, because the straps are too close to the center of the trousers and visible under the jacket, the front straps may be respectively engaged with the loops (LS, RS) on each side of the trousers. Thus, the Y type suspenders are applicable to the arrangement of the loops of the 5 type and the 7 type trousers. The Y type suspenders are very convenient, if they are used to limit the application, for example to the casual jeans and so forth.

Next, the H type and the X type suspenders have a pair of front straps, and a pair of rear straps. The said pair of front straps are applicable to the trousers having loops in the 5 type, 6 type, 7 type and 8 type by the foregoing method as described in the Y type suspenders. On the other hand, the said pair of rear straps are applicable to the trousers having loops in the 6 type and the 8 type, because these trousers have a pair of loops (BL, BR) near the rear center of the trousers. The X type and the Y type suspenders are applicable also to the trousers having loops in the 5 type and the 7 type, if the following engagement is used. As a result, these suspenders are applicable to all of the trousers having loops in the 5 type, 6 type, 7 type and 8 type.

When the trousers having loops in the 7 type are to be suspended by the H type and the X type suspenders, the interval between a pair of rear loops (BL, BR) of the trousers may be too wide for the free ends (BL, BR) of the rear straps of the suspenders. In such a case, these suspenders can be used by overlapping the two rear hooks 3 and 3 together and engaging them with the one loop (B) at the rear center of the trousers. It should be noted that it is easier to engage and disengage, if these two hooks of the rear straps are opened to right or left in the same direction. Upon engaging the two rear straps of the H type and the X type suspenders with the one loop (B) at the rear center of the trousers, some deflection may be caused in the two rear straps, if the suspenders have a limited flexibility at the branch point. However, if a tensile force is applied to the straps by suspending the trousers, the deflection is usually eliminated to practically cause no problem.

When the H type and the X type suspenders are to be applied to the trousers having loops in the 5 type, there is only one loop (B) at the rear center of the trousers. However, it is possible to suspend the trousers by overlapping both hooks fixed at the respective free ends (BL, BR) of the paired rear straps of the suspenders, and engaging them with the one loop (B) at the rear center of the trousers by using the foregoing method. Accordingly, they are also applicable to the trousers having loops in the 5 type.

The RX type suspenders have the two free ends (LS, RS) of straps on each side of the suspenders. Therefore, the arrangement of the loops of trousers applicable to the RX type suspenders is the type having loops (LS, RS) on each side of trousers, i.e., all of the 5 type, 6 type, 7 type and 8 type.

The hooks 3 to be used in the present invention are provided at the respective free ends of the straps of suspenders assembled in the Y type, X type, H type and RX type. Therefore, from two to four hooks are required in a pair of suspenders. The hooks 3 to be used in the present invention must be designed so that belt loops in use will not accidentally slip off easily. Both wide and narrow belt loops can be hooked up, if the internal width of the hook is made, say, from 10 to 12 mm.

Figure 2:
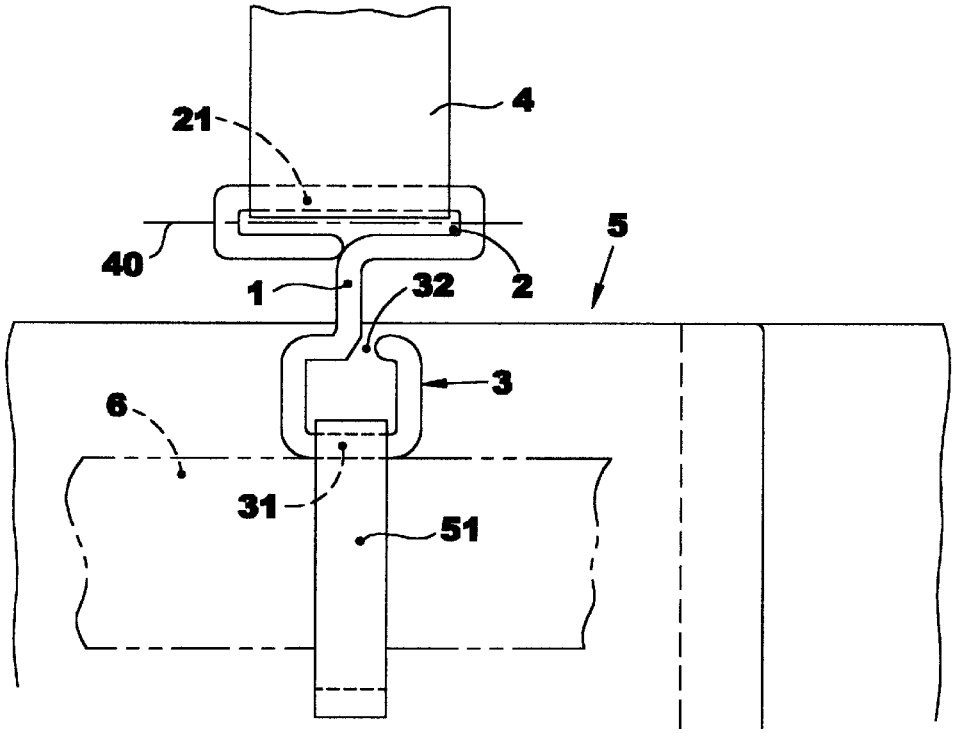
FIG. 2 is a plan view of the first embodiment of a hook used in the present invention.

FIG. 2 is an illustration showing the first embodiment of the hook used in the present invention. The hook has a through hole 2 at one end of a short connecting rod 1 and a hook 3 at the other end thereof.

The through hole 2 has a strap-hold 21 generally perpendicular to the longitudinal axis of the short rod 1. The strap-hold 21 is required to have a sufficient width to engage the free end 4 of the strap of the suspenders in a straight condition without wrinkles.

The hook 3 has a loop-hold 31 generally perpendicular to the longitudinal axis of the short rod 1 and an opening 32 for engagement and disengagement between one end of the loop-hold 31 and the short rod 1. It is necessary that the loop-hold 31 is sufficiently wide to engage with a belt loop 51 provided on trousers 5. Reference numeral 6 shows a belt in FIG. 2.

Figure 3:
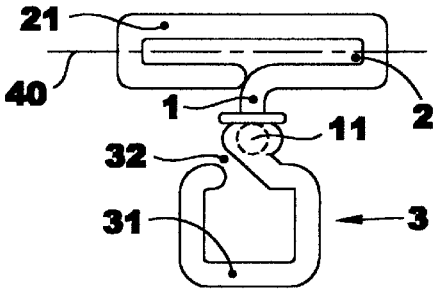
FIG. 3 is a plan view of the second embodiment of the hook shown in FIG. 2.

FIG. 3 is an illustration showing the second embodiment of the hook to be used in the present invention. The hook has a universal joint 11 and/or a swivel or anti-twister provided on the short rod 1. By this, the opening 32 of the hook 3 can be rotated relative to the through hole 2, so that the hook 3 may be engaged from both sides of the loop 51. A chain or a cord may be used as a simple type of the universal joint.

Figure 4:
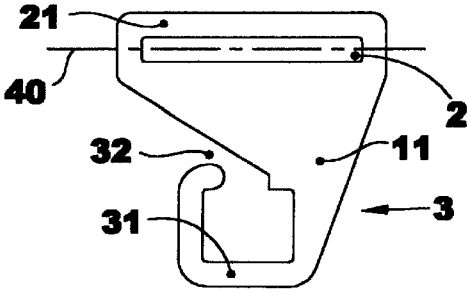
FIG. 4 is a plan view of the third embodiment of the hooks shown in FIGS. 2 and 3.

FIG. 4 is an illustration of the third embodiment of the hook to be used in the present invention. The through hole 2 and the hook 3 are integrally connected by a one-piece plate 12 to form the hook in place of the short rod 1. It is possible to easily and inexpensively form the entire hook by stamping one-piece plate into a shape as illustrated in FIG. 4.

As shown in FIGS. 2–4, each of the hooks provide a strap-hold 21 at one end and a hook portion 3 at the other end, and the hook portion 3 is provided as extending generally parallel to, as opposed to extending generally perpendicular to, a longitudinal axis 40 of the strap-hold 21. Such a configuration generally facilitates hooking of the hook portion 3 on a belt loop.

As set forth above in detail, the suspenders and methods of using them according to the present invention make use of desired loops among the ones arranged along the outside upper ends of trousers, noticing the fact that out of the normal types of trousers, the casual type has five loops, the normal type has six or seven loops and the formal type has eight loops, and through the hooks the free ends of straps branched in the suspenders can be freely connected or disconnected with the appropriate loops selected therefrom. Accordingly, the suspending method and the suspenders according to the present invention have general-purpose properties necessitating no special processing as long as the trousers are of the normal type, and it is possible to quickly, certainly and easily engage and disengage without taking a lot of time and effort in operations by the hooks. Furthermore, it has a much more practical effect such as successive application without damaging trousers in comparison with the conventional suspending methods and suspenders.

This invention is, of course, applicable to any special trousers fitting their loop positions to respective suspenders, although we have discussed the present invention with regard to the number and arrangement of loops in the normal type trousers.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A method of suspending trousers from one's shoulders using free ends of straps branched in suspenders, said method comprising:

fixing hooks at the respective free ends of straps branched in the suspenders;

selecting belt loops which a user of the suspenders wants to utilize from belts loops which are arranged along an outside upper end of said trousers for passing a belt therethrough; and engaging the hooks with the said selected belt loops.

2. A method as recited in claim 1, further comprising engaging the hooks of the suspenders with belt loops which are generally vertical when one who is wearing the trousers is standing generally erect.

* * * * *

UNITED STATES PATENT AND TRADEMARK OFFICE

CERTIFICATE OF CORRECTION

PATENT NO. : 6,088,839

DATED : July 18, 2000

INVENTOR(S) : Masanobu Utamaru

It is certified that error appears in the above-identified patent and that said Letters Patent is hereby corrected as shown below:

FIG. 4, "11" should be -- 12 --

Column 3, Line 22 "Y" should be -- H --

Signed and Sealed this

Seventeenth Day of April, 2001

Nicholas P. Godici

*Attest:*

NICHOLAS P. GODICI

*Attesting Officer*

*Acting Director of the United States Patent and Trademark Office*